US006137069A

United States Patent [19]

Casagrande et al.

[11] Patent Number: 6,137,069

[45] **Date of Patent: *Oct. 24, 2000**

[54] CIRCUIT BREAKER HANDLE INTERLOCK

[75] Inventors: Robert Casagrande, Oxford; Erich J. Pannenborg; Andre J. M'Sadoques, both of Southington, all of Conn.

[73] Assignee: General Electric Company, Schenectady, N.Y.

[ * ] Notice: This patent is subject to a terminal disclaimer.

[21] Appl. No.: 08/292,666

[22] Filed: Aug. 18, 1994

[51] Int. Cl.[7] ..... H01H 9/26

[52] U.S. Cl. ..... 200/50.32

[58] Field of Search ..... 200/50 R, 50 C, 200/50.01, 50.32, 50.33, 50.35, 50.37, 50.38, 50.39, 50.4 E; 335/8–10, 158–162

[56] References Cited

U.S. PATENT DOCUMENTS

| | | | |
|---|---|---|---|
| 3,183,320 | 5/1965 | Darlow | 200/50 |
| 3,213,326 | 10/1965 | Gryctko | 317/115 |
| 4,166,988 | 9/1979 | Ciarcia | 335/11 |
| 4,906,958 | 3/1990 | Adamson | 335/9 |
| 4,980,525 | 12/1990 | Kakiasako | 200/50 R |
| 5,172,087 | 12/1992 | Castonguay | 335/160 |

*Primary Examiner*—Michael Friedhofer
*Attorney, Agent, or Firm*—Carl B. Horton

[57] ABSTRACT

Multi-pole circuit breakers are joined together to form a common assembly. The individual poles are in the form of compact circuit breakers having a pair of separable contacts controlled by a single externally-accessible operating handle. The individual circuit breakers are riveted together and are keyed such that the contacts open and close in unison. The individual handles are interlocked together by means of a unitary plastic handle tie.

2 Claims, 2 Drawing Sheets

CIRCUIT BREAKER HANDLE INTERLOCK

BACKGROUND OF THE INVENTION

European market requirements for four and five pole circuit breakers have increased the number of individual circuit breakers that are fastened together to meet the additional pole requirements. To provide the additional strength to the circuit breaker handles, a metal pin is usually inserted through the handles and a plastic trough is then positioned over the handles to insure that all the handles respond in unison when one of the handles is actuated.

The provision of holes through the handles and the placement of the metal pin through the aligned holes present a problem when such circuit breakers are manufactured in a highly automated assembly process.

In some applications, grooves are formed in the top surface of the circuit breaker handles to allow the pins to be down-loaded during assembly.

U.S. Pat. No. 5,172,087 discloses a metal trough positioned over the pinned handles to provided added strength to the handles to insure that all the circuit breaker handles respond when a closing or opening force is applied to an end of the pinned handles rather than to the center.

U.S. Pat. No. 4,166,988 concerns the use of a single handle extension from the center of the pinned handles to insure that the pinned handles respond in unison.

U.S. Pat. No. 4,980,525 describes a press-fit connection between the plastic trough positioned over the pinned circuit breaker handles and the exposed portions of the metal pin to force the pinned handles to move in unison.

U.S. Pat. No. 4,906,958 teaches the use of a slotted plastic trough positioned over the circuit breaker handles to provide sufficient clearance within a circuit breaker load center enclosure.

One purpose of the instant invention is to provide a circuit breaker handle tie assembly that can be down-loaded in an automated circuit breaker manufacturing process and which does not require a metal pin for added strength.

SUMMARY OF THE INVENTION

Multi-pole circuit breakers are joined together to form a common assembly. The individual poles are in the form of compact circuit breakers having a pair of separable contacts controlled by an externally-accessible operating handle. The individual circuit breakers are riveted together and are keyed such that the contacts open and close in unison. The individual handles are shaped at their ends for retention in press-fit relation with detents formed within a unitary plastic handle tie.

DESCRIPTION OF THE PREFERRED EMBODIMENT

Figure 1:
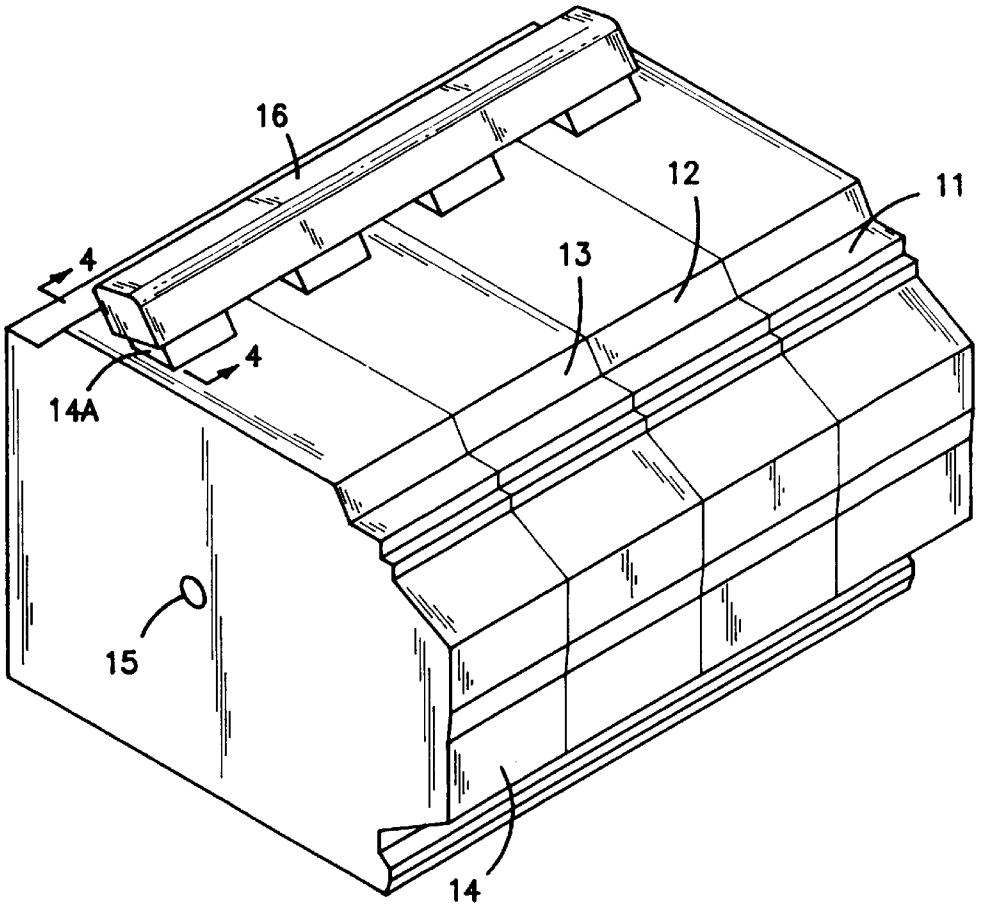
FIG. 1 is a top perspective view of four circuit breakers interlocked by means of the handle interlock tie in accordance with the invention.

A four pole circuit breaker 10 is depicted in FIG. 1 and consists of 4 individual circuit breakers or "poles" 11–14 pinned together by means of rivets 15. The handle tie 16 positioned over and attached to the operating handles, one of which is shown at 14A. The provision of the handle tie insures that the circuit breakers will respond in unison when the handle tie is translated to the circuit breaker ON and OFF positions in order to prevent "single phasing" whereby the circuit current within an associated protected electrical distribution system otherwise passes through a single pole. It is especially important that all circuit breaker poles become interrupted upon occurrence of an overcurrent condition through any one of the poles for the same reasons. The forces exerted by handle tie on the individual operating handles ordinarily vary in accordance to the location of the circuit breakers relative to the center of the handle tie. The circuit breakers operating handle at either end of the tie receiving the least force when the motivating force is applied to the center of the tie. To provide sufficient forces to the handle tie and to the circuit breaker operating handles, in accordance with the invention, the handle tie 16 is compartmentalized as indicated at 25 and the operating handles are slotted as indicated at 17, 18 on pole 14 within the multi-pole circuit breaker 10 shown in FIG. 2. To provide the greatest strength of the tie, the tie is left non-perforated to improve over the prior art slotted type handle ties as will be discussed below in greater detail.

Figure 4:
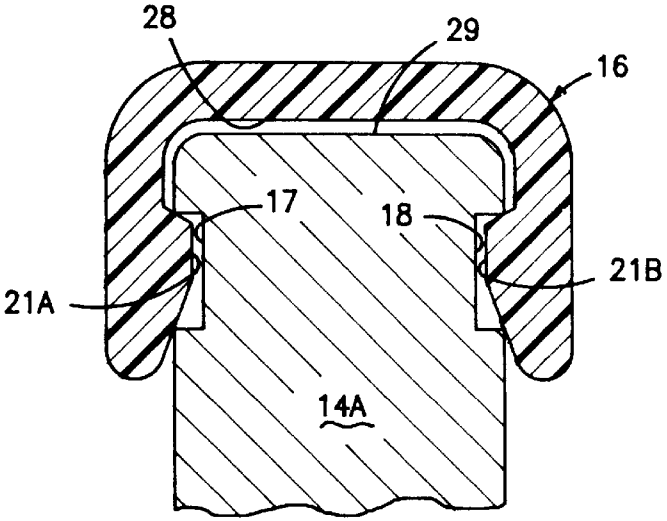
FIG. 4 is a an enlarged sectional view of the interlock tie of FIG. 1 through the 4—4 plane.
Figure 3:
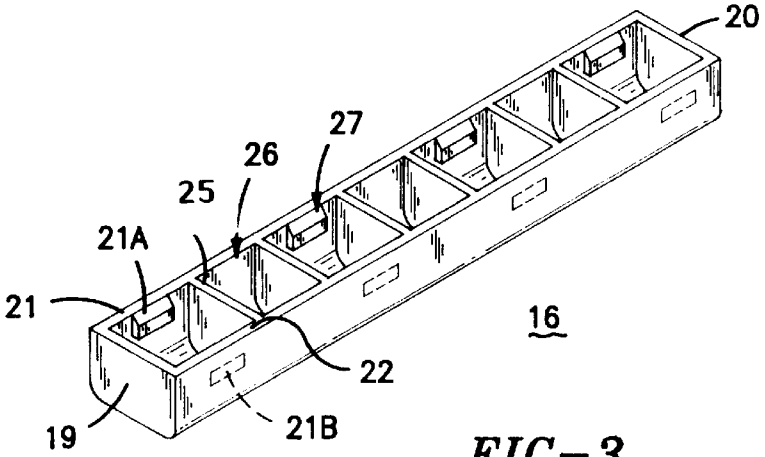
FIG. 3 is a an enlarged top perspective view of the interlock tie of FIG. 1 depicting the inner structure.

Referring now to FIG. 3, the handle tie is shown at 16 in the form of a unitary plastic casting having opposing U-shaped ends 19, 20 separated by extending side walls 21, 22. The circuit breaker handle-receiving compartments 25, 27 are separated by intervening support compartments 26. The compartments 25, 27 include detents 21A, 21B formed within opposing sidewalls 21, 22 to lockingly trap and retain the circuit breaker operating handles as best seen by now referring to FIG. 4.

When the handle tie 16 is positioned over the circuit breaker operating handles such as 14A, the detents 21A, 21B become trapped within the slots 17, 18 and force the handles into a press-fit capture within the handle tie. The inner radial surface 28 of the handle tie abuts the outer radial surface 29 of the operating handle to provide a compact fit between the operating handle and the handle tie. The abutment between the operating handle and the handle tie is an important feature of the invention. With handle ties wherein the ends of the handle extend through corresponding slots in the tie, as described earlier, it is possible to turn one of the circuit breaker handles to an ON or OFF position independently of the remaining circuit breaker handles presumably due to the clearance between the edges of the circuit breaker handles and the edges of the slots. This clearance also allows the slotted handle tie to be removed from the circuit breaker handles for test purposes which could be problematic if the handle tie is not repositioned over the handle when the testing is completed. The material used for the handle tie is thermoplastic such as Lexan which allows the handle tie to flex during the attachment and provides a tight mechanical bond with the thermoset material used for the circuit breaker operating handles. Tests to date indicate that the handle tie cannot be removed from the circuit breaker handles without imparting visual damage to either the handles and/or the tie. Lexan is a registered trademark of General Electric Company for polycarbonate resin.

Figure 2:
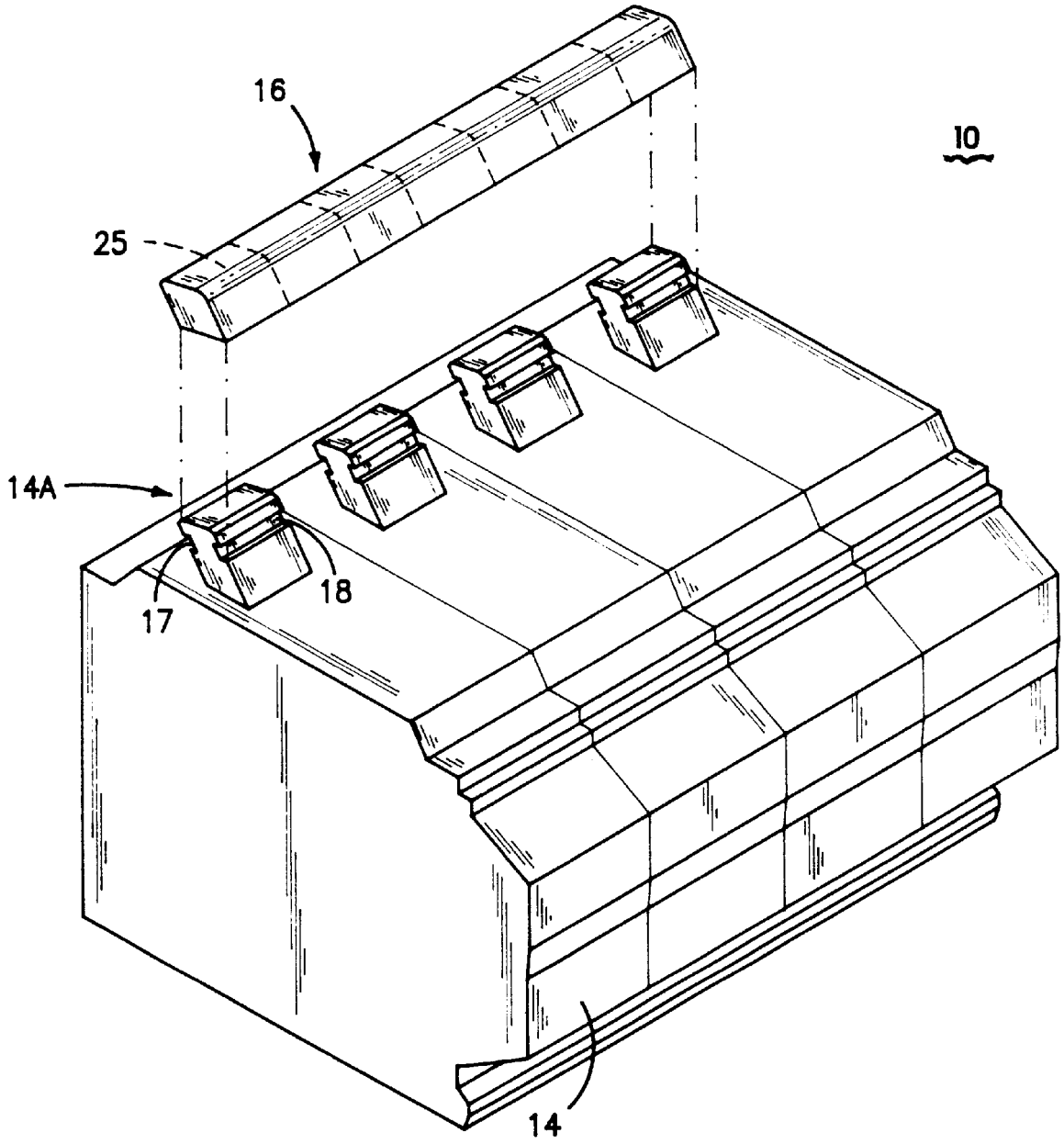
FIG. 2 is a top perspective view of the interlock tie of FIG. 1 prior to assembly.

With the handle tie attached to the circuit breaker handles, as shown in FIG. 2, the circuit breaker poles can be readily turned to the ON and OFF conditions in unison regardless of whether the handle tie is actuated at the center or at either end thereof.

What is claimed is:

1. A metal free handle tie for multi-pole circuit breakers comprising:

a molded plastic trough having a pair of opposing end walls and a pair of opposing sidewalls, said sidewalls being longer than said endwalls defining a rectangle, said endwalls defining a U-shaped configuration; and a plurality of first compartments within said trough, said first compartments formed by inner walls extending between said sidewalls, said first compartments including detent means integrally formed on opposite sides of said sidewalls, said detent means being arranged to capture slots formed on opposite sides of circuit breaker operating handles to lockingly retain said operating handles within said first compartments, said first compartments further define an inner surface that abuts an outer surface on said operating handles, when said operating handles are received within said first compartments, said inner surface and said outer surface comprise a radial configuration.

2. A multi-pole circuit breaker comprising:

a plurality of individual circuit breaker poles joined together to form a unitary configuration;

a corresponding plurality of circuit breaker operating handles extending from a top of said circuit breaker poles;

a non-perforated metal free plastic handle tie attached to said handles in a press-fit relation, said handle tie moving said operating handles in unison between ON and OFF positions; said handle tie comprising a molded plastic trough having a pair of opposing end walls and a pair of opposing sidewalls, said sidewalls being longer than said end walls defining a rectangle; and a plurality of first compartments within said trough, said first compartments formed by inner walls extending between said sidewalls, said first compartments including detent means integrally formed on opposite sides of said sidewalls, said detent means being arranged to capture slots formed on opposite sides of circuit breaker operating handles to lockingly retain said operating handles within said first compartments, said end walls define a U-shaped configuration, said first compartments further define an inner surface in abutment with an outer surface on said operating handles when said operating handles are within said first compartments, said inner surface and said outer surface comprise a radial configuration.

* * * * *